US011793320B2

(12) United States Patent
Stjerna

(10) Patent No.: US 11,793,320 B2
(45) Date of Patent: Oct. 24, 2023

(54) LOW DENSITY POCKET SPRING MATTRESS WITH INTEGRATED CUSHIONING PADS

(71) Applicant: Starsprings AB, Herrljunga (SE)

(72) Inventor: Nils Eric Stjerna, Herrljunga (SE)

(73) Assignee: Starsprings AB, Herrljunga (SE)

( * ) Notice: Subject to any disclaimer, the term of this patent is extended or adjusted under 35 U.S.C. 154(b) by 0 days.

(21) Appl. No.: 16/444,732

(22) Filed: Jun. 18, 2019

(65) Prior Publication Data

US 2019/0380503 A1 Dec. 19, 2019

(30) Foreign Application Priority Data

Jun. 19, 2018 (EP) ..... 18178596

(51) Int. Cl.
*A47C 27/06* (2006.01)
*A47C 27/04* (2006.01)
(Continued)

(52) U.S. Cl.
CPC ..... *A47C 27/064* (2013.01); *A47C 7/20* (2013.01); *A47C 7/347* (2013.01); *A47C 7/35* (2013.01); *A47C 27/056* (2013.01); *B68G 7/05* (2013.01)

(58) Field of Classification Search
CPC ..... A47C 27/066; A47C 27/06; A47C 27/064; A47C 27/065; A47C 27/0456; A47C 27/063; A47C 27/04
See application file for complete search history.

(56) References Cited

U.S. PATENT DOCUMENTS 2,610,333 A * 9/1952 Piliero ..... A47C 27/065 5/716
3,191,197 A * 6/1965 Frey ..... A47C 27/146 5/243
(Continued)

FOREIGN PATENT DOCUMENTS

DE 493292 C 3/1930
KR 20170000522 U 2/2017
(Continued)

OTHER PUBLICATIONS

European Search Report (EPO Form 1507N) European Patent Application EP 18178596.5 dated Jul. 20, 2018.
(Continued)

*Primary Examiner* — David R Hare
*Assistant Examiner* — Ifeolu A Adeboyejo
(74) *Attorney, Agent, or Firm* — Harness, Dickey & Pierce, P.L.C.

(57) ABSTRACT

A pocket spring mattress for use in a bedding or seating product is disclosed. The mattress comprises a plurality of interconnected coil springs enclosed in continuous covers forming strings of pockets accommodating the coil springs. Adjacent coil springs within each string are spaced apart by an interjacent separation distance, said separation distance exceeding at least 20 percent of the diameter of the largest one of the spiral turns of the adjacent coil springs. Further, the pocket spring mattress further comprises a cushioning pad located above the upper end of each coil spring, wherein the covers provides first compartments enclosing the coil springs, and second compartments enclosing the cushioning pads, said first and second compartments being separated from each other. The cushioning pads each have a length extension in the longitudinal direction of the strings exceed-
(Continued)

ing the diameter of the largest one of the spiral turns of the corresponding coil spring.

20 Claims, 8 Drawing Sheets

(51) Int. Cl.

| | |
|---|---|
| ***A47C 7/20*** | (2006.01) |
| ***A47C 7/34*** | (2006.01) |
| ***A47C 7/35*** | (2006.01) |
| ***A47C 27/05*** | (2006.01) |
| ***B68G 7/05*** | (2006.01) |

(56) References Cited

U.S. PATENT DOCUMENTS

| | | | | |
|---|---|---|---|---|
| 4,578,834 | A * | 4/1986 | Stumpf | A47C 27/064 156/291 |
| 6,397,418 | B1 | 6/2002 | Stjerna | |
| 6,490,744 | B1 * | 12/2002 | Schulz, Jr. | A47C 27/063 5/716 |
| 7,048,263 | B2 * | 5/2006 | Ahlqvist | A47C 27/064 267/91 |
| 8,176,589 | B2 | 5/2012 | Stjerna et al. | |
| 8,474,078 | B2 * | 7/2013 | Mossbeck | A47C 27/064 5/720 |
| 8,635,727 | B2 | 1/2014 | Dahlin et al. | |
| 9,332,856 | B2 * | 5/2016 | Eigenmann | A47C 7/746 |
| 9,554,656 | B2 | 1/2017 | Stjerna | |
| 10,098,474 | B2 * | 10/2018 | Häger | A47C 27/064 |
| 10,357,116 | B2 * | 7/2019 | Fisher | A47C 27/20 |
| 10,617,223 | B2 * | 4/2020 | Bayer | A47C 27/15 |
| 10,842,289 | B2 * | 11/2020 | Jewett | A47C 7/35 |
| 2003/0074736 | A1 * | 4/2003 | Grothaus | A47C 23/0433 5/655.8 |
| 2004/0025257 | A1 * | 2/2004 | Ahlqvist | A47C 27/064 5/655.8 |
| 2010/0011509 | A1 * | 1/2010 | Stjerna | A47C 27/064 5/720 |
| 2011/0004998 | A1 * | 1/2011 | Losio | A47C 27/16 5/699 |
| 2011/0041252 | A1 * | 2/2011 | DeFranks | A47C 27/064 5/655.8 |
| 2014/0373281 | A1 * | 12/2014 | Mossbeck | A47C 27/064 5/718 |
| 2015/0359350 | A1 * | 12/2015 | Eigenmann | A47C 23/043 5/652.1 |
| 2016/0045034 | A1 * | 2/2016 | Hager | A47C 27/045 5/720 |
| 2016/0270545 | A1 | 9/2016 | Codos | |
| 2017/0086597 | A1 * | 3/2017 | Dahlin | A47C 27/066 |
| 2017/0258242 | A1 * | 9/2017 | Codos | A47C 27/064 |
| 2018/0325274 | A1 * | 11/2018 | Hager | A47C 27/061 |

FOREIGN PATENT DOCUMENTS

| | | | |
|---|---|---|---|
| RU | 54497 | U1 | 7/2006 |
| RU | 74785 | U1 | 7/2008 |
| RU | 2465799 | C1 | 11/2012 |
| RU | 2465800 | C1 | 11/2012 |
| WO | WO-2014166927 | A1 | 10/2014 |
| WO | WO-2017/155776 | A1 | 9/2017 |

OTHER PUBLICATIONS

Russian Decision on Granting dated Feb. 2, 2023 for corresponding Russian Application No. 2020140485, and English-language translation thereof.

* cited by examiner

LOW DENSITY POCKET SPRING MATTRESS WITH INTEGRATED CUSHIONING PADS

CROSS-REFERENCE TO RELATED APPLICATION

This present application claims priority under 35 U.S.C. § 119 to European Patent Application No. 18178596.5, filed Jun. 19, 2018, in the European Patent Office, the entire contents of which are hereby incorporated by reference.

TECHNICAL FIELD OF THE INVENTION

The present invention relates to a spring mattress of the kind wherein the springs are enclosed in covers, known as a pocket spring mattress, and to method of manufacturing a mattress of this kind.

BACKGROUND OF THE INVENTION

One common technique of manufacturing spring mattress is the one known as the pocket technique. According to this technique, the springs are enclosed in pockets, i.e. they are enclosed individually by a cover material. Owing to this arrangement, the springs become relatively individually resilient, such that each spring may flex separately without affecting adjacent springs, which increases the user's comfort, since the load will be distributed more evenly across the surface that receives the load.

One problem inherent in this type of mattresses is, however that they are a great deal more expensive to manufacture than many other types of spring mattresses. A solution to this problem has previously been proposed in U.S. Pat. No. 7,048,263, by the same applicant. The therein disclosed mattress is a pocket mattress where the coil springs are more separated from each other than in conventional pocket spring mattresses, by providing of two separated transversal connection lines between pairs of adjacent coil springs. Hereby, the density of springs in the mattress was significantly decreased, making the mattress less costly to produce. At the same time, it was surprisingly found that the overall comfort of the mattress was not in any way negatively affected by this decreased spring density.

However, beds and seating arrangements using mattresses of this type are still relatively difficult and costly to produce. The increased separation distance of the mattress needs to be maintained in a reliable manner, e.g. making it necessary to attach the outer rim of the mattress to a rigid frame, e.g. made of steel, to fixedly attach the mattress to a bed base, or the like. Further, in order to provide good comfort, it is often necessary to provide one or several layers of upholstery, such as foam, cloth and the like, to provide an even and comfortable resting surface. Such upholstery layers make the mattress/bed more complicated to produce, and more costly, and also reduces the inherent individual resiliency and comfort of the pocket spring core.

Thus, there is still a need for an improved pocket spring mattress, providing the same or an even improved level of comfort, but which can be produced and used more cost-effectively. It is also a need for such individual pocketed coil springs and pocket spring mattresses that delivers improved resiliency and responsiveness and that enables the use of reduced amounts of cushioning or padding material on top of the bedding or seating product once the spring assembly is complete. Still further, there is a need for such individual pocketed coil springs and pocket spring mattresses that are more robust and which maintains their properties over a prolonged period of time and use.

SUMMARY OF THE INVENTION

It is therefore an object of the present invention to provide a pocket spring mattress of the kind defined in the introduction, and a method of manufacturing such a mattress, by means of which the disadvantages referred to above are at least partly alleviated.

This object is achieved by a pocket spring mattress and a method of manufacturing such a mattress as defined in the appended claims.

According to a first aspect of the invention there is provided a pocket spring mattress for use in a bedding or seating product comprising a plurality of interconnected coil springs enclosed in continuous covers forming strings of pockets accommodating the coil springs, the coil springs within each string being separated by transversal connection lines, and a plurality of such strings being arranged in parallel with each other and connected to each other, wherein adjacent coil springs within each string are spaced apart by an interjacent separation distance, said separation distance exceeding at least 20 percent of the diameter of the largest one of the spiral turns of the adjacent coil springs, the coil springs each having an upper and a lower end, and the pocket spring mattress further comprising a cushioning pad located above the upper end of each coil spring, wherein the covers provides first compartments enclosing the coil springs, and second compartments enclosing the cushioning pads, said first and second compartments being separated from each other, and wherein each cushioning pad has a length extension in the longitudinal direction of the strings exceeding the diameter of the largest one of the spiral turns of the corresponding coil springs. Thus, the two compartments form a pocket unit, with the compartments arranged overlying each other, and a plurality of such pocket units distributed over the mattress' width and length direction.

By "corresponding coil springs" is in the present application meant the coil spring over which any particular cushioning pad is arranged, i.e. the coil spring arranged in the same pocket unit as the cushioning pad.

The separation of the coil springs within the strings is here obtained in a similar way as in the above-discussed U.S. Pat. No. 7,048,263, said document hereby being incorporated in its entirety by reference. However, in contrast to said previously known solution, the provision of cushioning pads above each coil spring, and in dedicated, integrated compartments overlying the compartments accommodating the coil springs, several very surprising advantageous effects are achieved.

The increased separation between the coil springs makes the mattress easier and less costly to produce, and also improves circulation and aeration of the mattress. Further, the large separation does not affect the properties and comfort of the mattress, and it has been found to be as good as or even better than conventional pocket spring mattresses.

Use of integrated cushioning pads in a pocket spring mattress is per se known from U.S. 2016/045034, also by the same applicant, and hereby incorporated in its entirety by reference. However, in the present invention, the cushioning pads are arranged overlying highly separated coil springs. Further, the cushioning pads are provided with a length in the lengthwise direction of the strings which exceeds the diameter of the largest one of the spiral turns of the coil springs. The cushioning pads are also securely fixated in relation to the coil springs by being provided in separate compartments formed in the strings. Thus, the positions of the cushioning pads are securely and reliably maintained at all times, and the extensive length of the cushioning pads thereby maintains the separation between the coil springs in the string. Consequently, with this new type of mattress, there is no longer any need for steel frames and other complicated and expensive measures to maintain the separation of the coil springs. Instead, the large cushioning pads span out the surface of the mattress, thereby effectively ensuring that the underlying coil springs are kept in the intended, highly separated positions.

Further, by the provision of at least one cushioning pad within each individual pocket, each coil spring functions independently, resulting in a more comfortable bedding or seating product. Hereby, the individual resilience of the coil springs in the pockets is maintained, providing excellent comfort and pressure distribution.

Further, in this new type of pocket spring mattress, there is no need for additional padding layers, since a cushioning pad is already incorporated in each pocket unit. Further, since very large cushioning pads are used, the cushioning pads will span out the upper surface of the mattress, thereby forming a planar and very even upper surface, which is yet individually resilient. Hereby, the need for upholstery layers etc is reduced, and the mattress may e.g. be used without any upholstery layers at all, or with only a thin layer of fabric, cloth or the like. Thus, this makes the mattress, and the use of the mattress to form bed arrangements, seating products and the like, even more cost effective, and at the same time providing increased comfort for the user.

Further, manufacturing of this new type of pocket spring mattress is relatively simple and cost-efficient, since there is e.g. no need to connect the cushioning pad directly to the coil springs. Instead, the cushioning pad is arranged in a separate compartment, arranged on top of the pocket enclosing the coil spring. This makes it possible to use a conventional manufacturing process for making pocket mattresses, and to simply add a separate compartment on top of each pocket unit to incorporate the cushioning pad. Hereby, the present invention lends itself very well to automated and cost-efficient manufacturing, and it is also relatively simple to incorporate the additional steps of providing a separate compartment for the cushioning pad and to insert such cushioning pads into said compartments in previously known and used manufacturing processes and equipment.

Further, the fact that the coil spring and the cushioning pad in each pocket unit is separated from each other, and arranged in separate compartments, ensures that the cushioning pad will always remain in place. The casing material of the compartment encasing the coil spring hinders the cushioning pad of getting displaced during use. Consequently, the appearance and the comfort of the mattress will be maintained even during a prolonged period of use, thereby providing a long longevity of the product.

The new pocket spring mattress can be used in a wide variety of bed- and seating arrangements. As one example, it may e.g. be used in bed- or seating arrangements where the mattress should be expandable and contractible between an extended state, where the mattress area is larger, and the density of springs lower, e.g. for sleeping, and a contracted state where the mattress area is smaller and the density of springs higher, e.g. for sitting. Such mattresses are per se known, and are e.g. very useful in vehicles, such as lorries/trucks. Such expandable/contractible mattresses and bed- and seating arrangements are per se known from e.g. U.S. 2017/086597, U.S. Pat. Nos. 8,176,589, 8,635,727 and 9,554,656, all by the same applicant, and incorporated herein by reference in their entirety. Use of the mattress of the present invention in such expandable/contractible bed- and seating arrangements provides additional surprising advantages. Since the cushioning pads are generally elastically compressible, the surface of the mattress will remain planar and smooth both in an expanded state and in a contracted state. Further, the cushioning pads will, due to their elasticity, provide a force to move the mattress from a compressed state into an expanded state. This facilitates the transition from the compressed state to the expanded state, and also ensures that the springs and pockets remain evenly distributed at all times, both in the contracted state, the expanded state and any intermediate state there between.

The separation distance between the adjacent coil springs may be provided in various ways. In one alternative, the transversal connection lines have a width in the lengthwise direction of the strips forming said separation distance. The transversal connection lines may hereby comprise a solid, wide continuous connection line, or may alternatively comprises a line formed of separate elements, arranged following after each other along the extent of the connection lines, such as relatively wide rectangles, circles, ovals, and the like. As another alternative, the separation distance may be provided by two, preferably parallel, transversal connection lines provided between adjacent coil springs, the lines being spaced apart in the longitudinal direction of the strings to form the separation distance. The connection lines may be formed by ultrasonic welding, stitching, clamping, adhesion or in any other suitable manner.

The cover material forming the two compartments may comprise a first piece of fabric forming said first compartment, and a second piece of fabric forming said second compartment. Hereby, the first piece of fabric may be used in a conventional way, for providing strings of individually pocketed coil springs, and a second piece of fabric may then be added to provide the additional compartment for housing the cushioning pad, either during the forming of the string of the first fabric, or subsequently, after the formation of the string of the first fabric.

Preferably, the first piece of fabric entirely encloses the coil spring, and the second piece of fabric is arranged to partly enclose the first compartment, and to be secured to the first piece of fabric. Thus, the first piece of fabric may be arranged to completely surround the coil springs, and in itself forming the first compartments, whereas the second piece of fabric may be arranged to partly surround the cushioning pad. The second fabric may to this end have two ends, each being connected to the first fabric on opposite sides of the string. The second compartments are in this embodiment formed by the second fabric, forming the top and side walls of the compartments, and the first fabric, forming the bottom wall of the compartments.

In a preferred embodiment, the second piece of fabric is secured to the first piece of fabric along a few transverse connection lines extending parallel to the longitudinal direction of the coil spring, said connecting lines preferably consisting of a surface joint, such an adhesive, a weld or the like. Hereby, connection of the second piece of fabric may easily be incorporated in the conventional pocket spring manufacturing process.

In this embodiment, the first fabric may be provided with the first transversal connection lines forming the interjacent separation distance between the coil springs, such as by use of two parallel, separated first transversal connection lines between each pair of adjacent springs. Further, the second fabric may be provided with more narrow second transversal connection lines, such as a narrow single second transversal connection line, between each pair of adjacent cushioning pads, so that the cushioning pads are arranged close to each other, without any separation distance between them, or with only a very small separation distance.

In this embodiment, the second fabric may be connected to the first fabric via the first transversal connection lines in the area where the first and the second fabric overlap by extending the connection lines in this area through both the first and the second fabric. Additionally or alternatively, the second fabric may be connected to the first fabric via the second transversal connection lines in the area where the first and the second fabric overlap by extending the connection line through both the first and the second fabric. Additionally or alternatively, a separate connection may be provided between the first and the second fabric. Such a separate connection may be arranged overlying or adjacent to the first and/or the second transversal connection lines.

Preferably, the second fabric is attached to the first fabric solely by connection points or connection lines formed by or arranged overlying or adjacent the first and/or second transversal connection lines. However, alternatively, there may instead or in addition also be provided connection points or connection lines between the first fabric and the second fabric at other positions, such as in the middle between the transversal connection lines forming each pocket, i.e. overlying the coil springs.

However, instead of forming the two compartments by two separate pieces of fabric, the first compartment and the second compartment may alternatively be formed by a single piece of fabric. For example, it is possible to arrange the fabric in an S-shape to form separate compartments, as is disclosed in U.S. Pat. No. 6,397,418 by the same applicant, said document hereby being incorporated in its entirety by reference.

In the same way as in the above-discussed first embodiment, there may also in this embodiment be provided first transversal connection lines forming the interjacent separation distance between the coil springs, such as by use of two parallel, separated first transversal connection lines between each pair of adjacent springs, and more narrow second transversal connection lines, such as a narrow single second transversal connection line, between each pair of adjacent cushioning pads, so that the cushioning pads are arranged close to each other, without any separation distance between them, or with only a very small separation distance. Further, the loose ends of the single piece of fabric may be connected together at the overlapping areas by the first and/or second transversal connection lines or, additionally or alternatively, by a separate connection.

Regardless of whether the compartments are formed by a single fabric or by two fabrics, each pocket unit may here be seen as two overlying compartments, formed by a common external cover encircling both compartments, and a common partition wall connected to or integrated with the external cover, and extending between the coil spring and the cushioning pad, thereby separating the two compartments.

The extension of the partition wall between the junctions to the external cover preferably exceeds that of the lateral dimensions of the coil springs, i.e. exceeds the diameter of the largest coil turn/convolution. This may e.g. be accomplished by connecting the second fabric to the first fabric in such a way that the extension of the first fabric extending between these connections to the second fabric, and thus forming said partition wall, exceeds the diameter of the coil springs. Owing to this arrangement, the part of the partition wall against which the spring and cushioning pad abut is moveable between an upper and a lower end position, without affecting the external cover at the areas of junction of the partition wall to the external cover. In this manner, each pair of springs and cushioning pads may flex individually between these end positions within the area of extension inside the pocket. Such an arrangement of a partition wall being moveable between an upper and lower end position is per se known from U.S. Pat. No. 6,397,418 by the same applicant, said document hereby being incorporated in its entirety by reference.

The dimensions of the pocket, i.e. the external cover, the coil springs and the cushioning pads are preferably such that the coil springs are maintained in a biased, state, and wherein the partition walls are maintained in the upper end position when no external pressure is applied. Hereby, the pocket units become even more independently resilient.

However, it is also possible to maintain the partition wall, when the pocket units are unbiased, between the upper and lower end position. Such an arrangement ensures that the overall dimensions of the pocket units will be maintained even if the dimensions of the cushioning pads are altered during use. It is e.g. common that cushioning pads of this type will lose some of their initial shape during use, and e.g. lose some of their initial thickness. However, the biased coil spring and the partition wall not being in the upper most position will compensate for this, and the upper surface of the pocket units and the mattress will be maintained in the same shape and position. Thus, a mattress comprising such pocket units will maintain its smooth and even upper surface, and consequently its original appearance, even after a substantial period of use, and even when some deterioration of the cushioning pads have occurred.

Each coil spring preferably comprises an upper end turn, a lower end turn and a plurality of convolutions between said end turns. Preferably, the coil spring comprises 2-10 convolutions, and most preferably 5-8 convolutions.

At the side of the mattress being opposite to the cushioning pads, a stabilizing sheet may be connected to the strings. This stabilizing sheet is preferably made of a flexible material, and may e.g. comprise a fabric, such as a non-woven fabric, and preferably extends over the entire mattress surface. The sheet may be connected to the bottom side of the strings by adhesive, welding or the like. The stabilizing sheet hereby stabilizes the mattress in the side being opposite to the cushioning pads, and assists in maintaining the coil springs in upright, separated positions.

However, alternatively, the pocket spring mattress may further comprise second cushioning pads located below the lower end of each coil spring. Such second cushioning pads may be arranged in a third compartment formed in the string, the third compartment being separated from the first and second compartments. Thus, each pocket unit hereby contains two cushioning pads located above and below the end turns of the coil spring, respectively. Hereby, cushioning pads will be provided at both sides of the mattress, which makes the mattress useable with both sides turned upwards. The cushioning pads at both ends may be identical or similar, thereby providing equal properties on both sides. This will increase the longevity of the pocket units and the mattress. However, the cushioning pads may also be different, thereby providing a choice for the user between different properties by selecting which side to use as the upper side. The second cushioning pads preferably also have length extensions in the longitudinal direction of the strings exceeding the diameter of the largest one of the spiral turns of the corresponding coil springs.

In forming a string of springs, once a strip of fabric has been wrapped around a row of aligned coil springs, the longitudinal edges of the strip of fabric are joined together with a longitudinal line of attachment in any known manner, such as sewing, welding or gluing. Opposed plies of the strip of fabric on opposite sides of the coil springs are joined together between the coil springs with transverse lines of attachment, which similarly may be ultrasonic welds, sewing lines, glue lines or any other means of attaching the plies to each other. The additional compartments for housing the cushioning pads may be provided by means of additional pieces of fabric, or by wrapping of the same fabric in a way providing additional compartments. The strip of fabric further preferably comprises at least one longitudinal connecting line extending parallel to the longitudinal direction of the string, which define said pockets together with the plurality of transverse connecting lines extending transversely to the longitudinal direction of the string.

The cushioning pads may include at least one piece of foam, and preferably foam made of urethane or latex. One or several of the cushioning pads may also comprise a piece of cloth secured to a piece of foam. For example, the cushioning pad may be a piece of urethane or latex foam, and optionally sandwiched between one or two pieces of cloth. However, the cushioning pad may also comprise multiple pieces of foam. In addition to foam, other materials such as memory foam, gel or cotton may be used to form the cushioning pad.

In one embodiment, the cushioning pads include a layered construction comprising a softer foam arranged in a sandwiched configuration with a firmer foam. In this arrangement, the softer foam is preferably arranged on top of the firmer foam, so that the softer foam faces the upper mattress surface, and the firmer foam faces the coil spring.

The cushioning pads may have a width extension in the width direction of the strings, wherein the width extension is smaller than the length extension, said width extension preferably being essentially equal to the diameter of the largest one of the spiral turns of the coil springs. However, alternatively, the width extension of each cushioning pad may also exceed the diameter of the largest one of the spiral turns of the corresponding coil spring.

The length extension of the cushioning pads preferably exceeds the diameter of the largest one of the spiral turns of the corresponding coil springs by at least 15%, and preferably by at least 20%. Most preferably, the length extension of the cushioning pads exceeds the diameter of the largest one of the spiral turns of the corresponding coil springs by 75-100% of the interjacent separation distance between the coil springs, and more preferably by 80-100%, and most preferably by 90-100%.

The interjacent separation distance between the coil springs preferably exceeds 25 percent of the diameter of the largest one of the spiral turns of the adjacent springs, and preferably exceeds 30 percent, and most preferably exceeds 50%.

The interjacent separation distance between the coil springs preferably exceeds 2 cm, and more preferably exceeds 4 cm, and most preferably exceeds 6 cm.

The cushioning pads preferably have a length extension in the longitudinal direction of the strings exceeding the diameter of the largest one of the spiral turns of the corresponding coil springs with at least 15%, and preferably at least 20%, and more preferably at least 25%, and most preferably at least 50%.

The cushioning pads preferably have a length extension in the longitudinal direction of the strings exceeding the diameter of the largest one of the spiral turns of the corresponding coil springs by at least 2 cm, and more preferably by at least 3 cm, and more preferably by at least 5 cm.

It is particularly preferred that mattresses in accordance with the invention have a spring density in at least one lengthwise direction, in which separation distances are provided, of less than 15 springs per meter, and preferably less than 13 springs per meter. The resulting mattress is a great deal more simple and less expensive than conventional mattresses, which as a rule have 30 springs and more in the lengthwise direction of the mattress.

The cushioning pads are preferably arranged on top of the coil springs in such a way that the cushioning pads extend out from the corresponding coil springs in the longitudinal direction of the strings. Preferably, the cushioning pads are arranged essentially centralized over each corresponding coil spring, so that the cushioning pads extends out from the coil spring with essentially the same length on each side, both in the length direction of the strings and in the width direction of the strings. Hereby, the support offered by the cushioning pads, in particular at the interjacent separation between the coil springs, is improved, providing a more comfortable mattress.

In one embodiment, the cushioning pads have a generally rectangular configuration, and preferably with beveled or rounded corners. Hereby, the cushioning pads will cover essentially the whole upper surface of the mattress. However, alternatively the cushioning pads may have a circular, hexagonal, octagonal shape, and many other geometrical configurations are also feasible.

The casing is preferably made of a weldable textile material.

The parallel strings are preferably arranged side by side and interconnected by surface attachment between abutting surfaces, wherein the surface attachment adapted to interconnect the strings preferably comprises at least one of gluing and welding. However, other conventional fasteners, such as hog rings, may also be used.

Due to the interjacent separation distance provided between the coil springs, the mattress becomes less compact, whereby fewer springs are required, the operational step of enclosing the springs in covers becomes easier and so on. The mattress thus becomes both easier and less expensive to manufacture. Surprisingly enough it has been found, however that the properties of the mattress are not noticeably affected from being less compact but that essentially the same qualities of comfort are achieved in the inventive mattress as in conventional pocket-spring mattresses. In fact, it has even been found that in some cases the increased distance between the springs adds to the individual resilience of the spring, which increases comfort, since each individual spring is able to support loads comparatively independently. At the same time, the large cushioning pads provide a smooth, comfortable and relatively dense upper surface on the mattress.

According to another aspect of the invention, there is provided a method of manufacturing a spring mattress of the kind comprising a plurality of interconnected coil springs enclosed in continuous covers forming strings of pockets accommodating the coil springs, comprising:

enclosing the springs in a continuous cover material;

forming pockets in the continuous cover material by providing transversal connection lines between adjacent coil springs; and interconnecting several strings with one another;

wherein adjacent coil springs within each string are spaced apart by an interjacent separation distance, said separation distance exceeding at least 25 percent of the diameter of the largest one of the spiral turns of the adjacent coil springs, the coil springs each having an upper and a lower end, and the further comprising providing a cushioning pad above the upper end of each coil spring, wherein the covers provides first compartments enclosing the coil springs, and second compartments enclosing the cushioning pads, said first and second compartments being separated from each other, and wherein the cushioning pads have a length extension in the longitudinal direction of the strings exceeding the diameter of the largest one of the spiral turns of the corresponding coil springs.

Notably, the order of the above defined method steps may vary. For example, the enclosing of the springs and the enclosing of the cushioning pads may, in an automated manufacturing procedure be made in any order, and can also be made simultaneously. Further, the connection lines can be provided in any order, and can also be provided simultaneously.

In accordance with this aspect, similar advantages and specific features as discussed above, in relation to the first aspect, are obtainable. Further, advantages and embodiments of the invention will be apparent from the following detailed description of the invention.

BRIEF DESCRIPTION OF THE DRAWINGS

These and other aspects of the present invention will now be described in more detail, with reference to the appended drawings showing embodiments of the invention.

DETAILED DESCRIPTION

Figure 1:
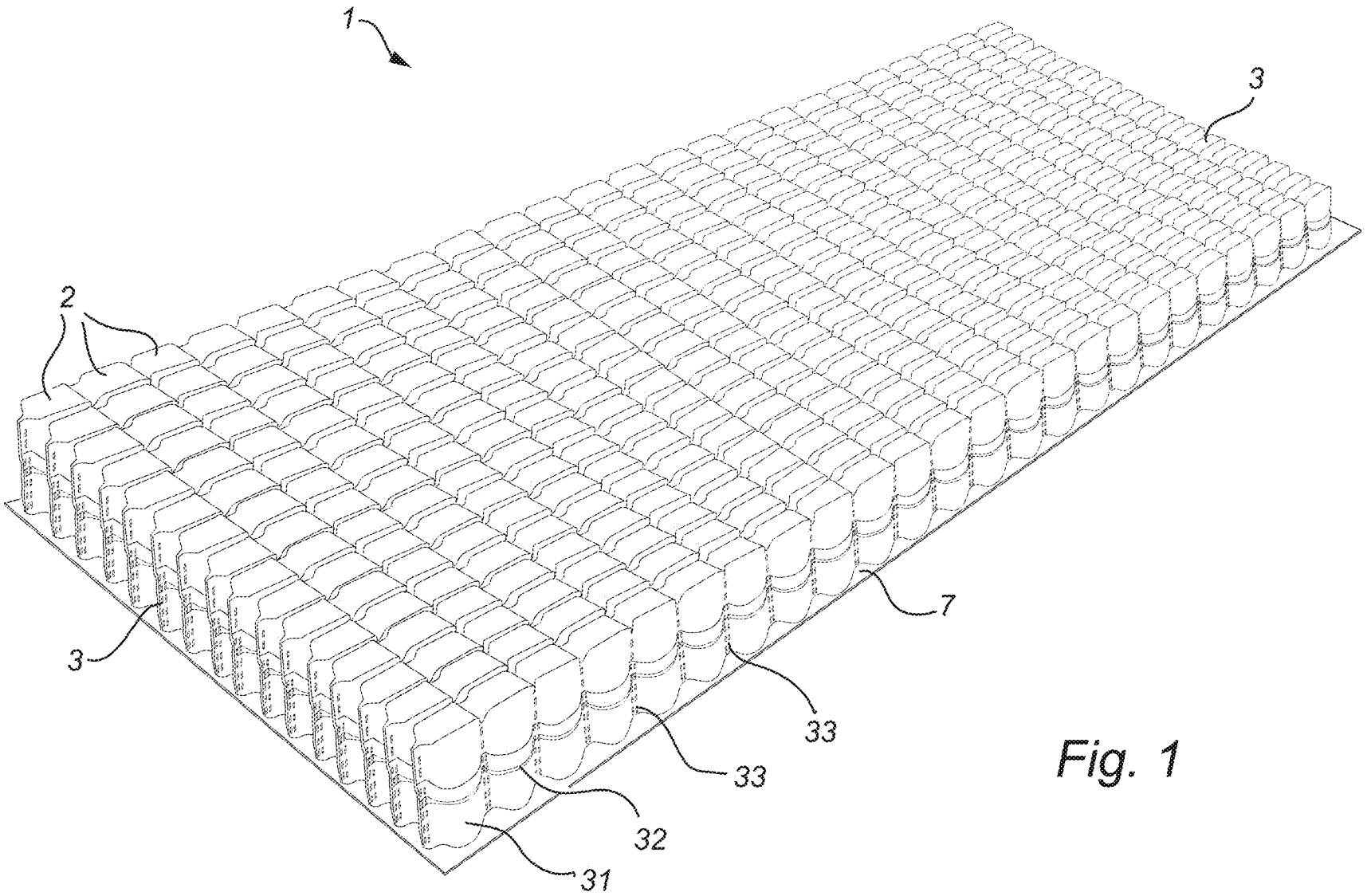
FIG. 1 shows a schematic perspective view of an embodiment of a mattress according to an embodiment of the present invention.

With reference to FIGS. 1-10, there is illustrated a mattress 1 embodying the invention of this application. Although a mattress is illustrated, the present invention may be used to construct any bedding or seating product. This mattress 1 comprises a plurality of individually pocketed coil spring units 2.

The mattress 1 is here formed from a plurality of parallel strings 3 of individually pocketed coil spring units 2. Each string 3 of pocketed coil springs 2 preferably comprises a fabric covering or strip of fabric 31 within which there is located a row or column of aligned coil springs. Individual pockets are here formed by longitudinal connecting lines 32, extending along the strings e.g. on the top or at the middle of the strings, and by transversal connecting lines 33, extending in the axial direction of the springs. Adjacent strings of springs 3 may be secured to each other by surface attachments on adjacent surfaces, such as by gluing, ultrasonic welding, hog rings or any other means.

In the above-discussed embodiments, the individually pocketed coil spring units are arranged as continuous strings, arranged side-by-side, and extending in parallel to each other, in a width or length direction of the mattress, or any other spring assembly. However, several alternative configurations are feasible. For example, the strings may occur non-linearly, in serpentine shapes or the like. Further, the individually pocketed coil spring units may be provided as single units, or shorter strings, consisting of only a few individually pocketed coil springs.

Figure 2:
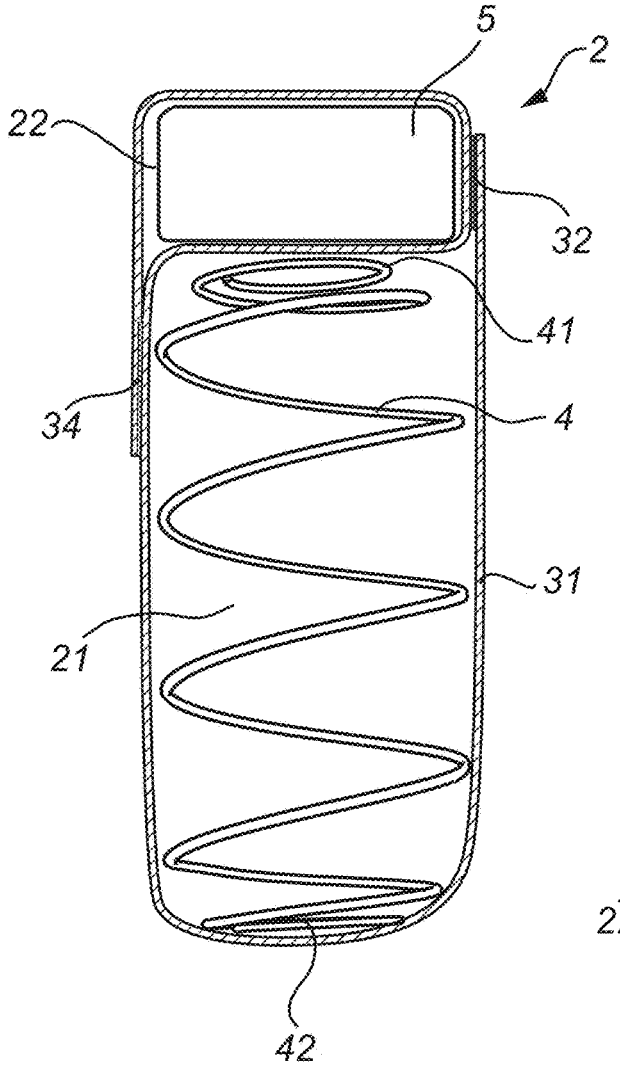
FIG. 2 shows a cross-sectional view of an individually pocketed coil spring in accordance with a first embodiment of the present invention.
Figure 3:
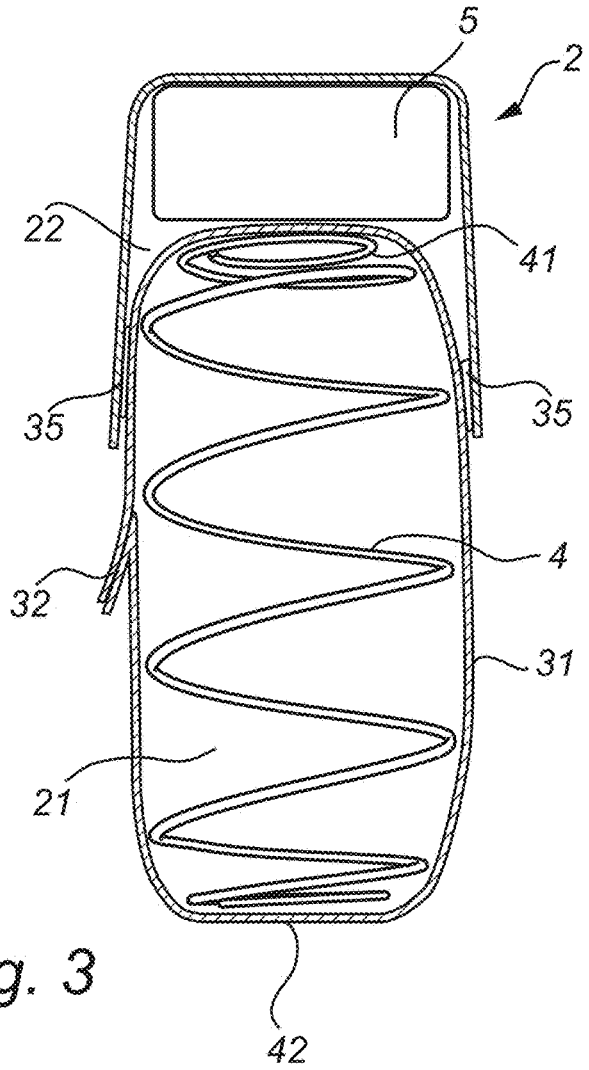
FIG. 3 shows a cross-sectional view of an individually pocketed coil spring in accordance with a second embodiment of the present invention.
Figure 4:
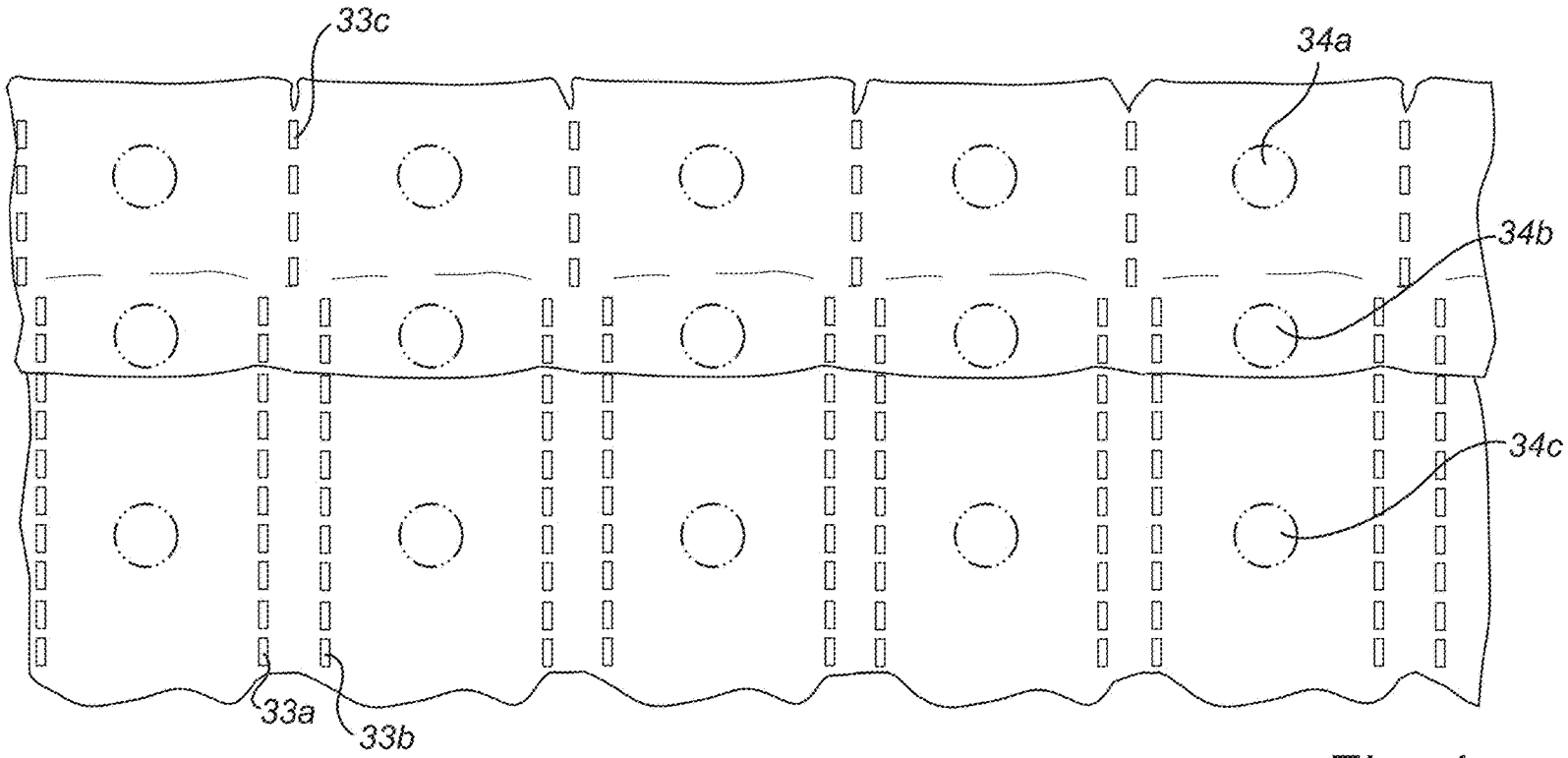
FIG. 4 is a side view of a part of a string in accordance with an embodiment of the present invention.

As best seen in FIGS. 2-4, each individually pocketed coil spring unit comprises a casing 31 forming the pocket, and providing a first compartment 21 enclosing a coil spring 4, and a second compartment 22 enclosing a cushioning pad 5. The first and second compartments are separated from each other. The coil springs each has an upper end 41 and a lower end 42. The second compartment 22 is arranged above the first compartment 21, so that the cushioning pad 5 is located above the upper end 41 of the coil spring 4. Thus, the cushioning pads may hereby be maintained in place solely by being enclosed in the compartments, without the need for any additional fixation.

The adjacent coil springs within each string are spaced apart by an interjacent separation distance, exceeding at least 25 percent of the diameter of the largest one of the spiral turns of the adjacent coil springs. Further, the cushioning pads located above the upper end of each coil spring, in a separate compartment of the pocket casing, each has a length extension in the longitudinal direction of the strings exceeding the diameter of the largest one of the spiral turns of the corresponding coil springs. Hereby, the cushioning pads bridges the gap formed between the springs, thereby maintaining the separation distance between the springs and also providing a smooth upper surface of the mattress.

Figure 9:
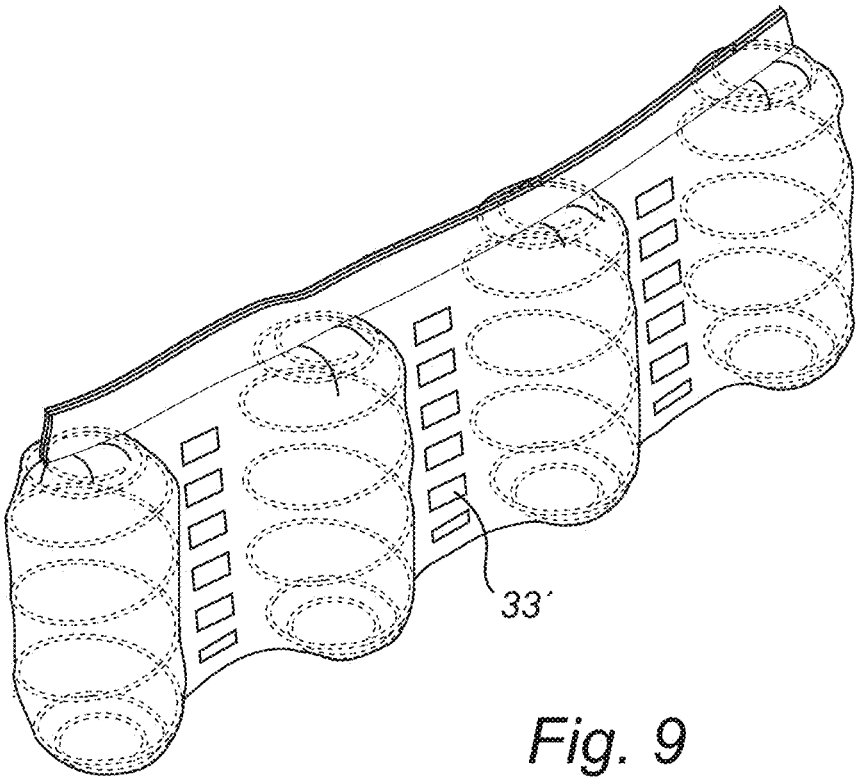
FIG. 9 shows a part of a string comprising separated springs in accordance with another embodiment of the invention.

The separation distance between the adjacent coil springs may be provided in various ways. In one alternative, the transversal connection lines have a width in the lengthwise direction of the strips forming said separation distance. The transversal connection lines may hereby comprise a solid, wide continuous connection line, or may alternatively comprises a line formed of separate elements, arranged following after each other along the extent of the connection lines, such as relatively wide rectangles, circles, ovals, and the like. Such an embodiment is shown in FIG. 9, where wide transversal connection lines 33' are provided, here formed as a discontinuous line.

Figure 8:
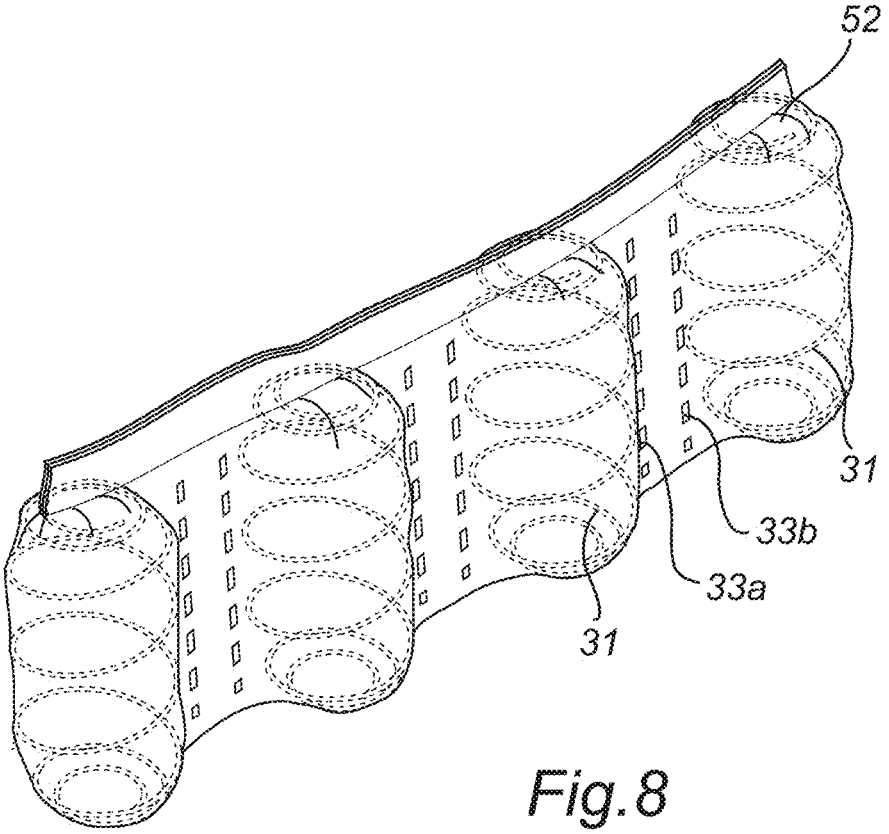
FIG. 8 shows a part of a string comprising separated springs in accordance with one embodiment of the invention.

As another alternative, the separation distance may be provided by two, preferably parallel, transversal connection lines provided between adjacent coil springs, the lines being spaced apart in the longitudinal direction of the strings to form the separation distance. The connection lines may be formed by ultrasonic welding, stitching, clamping, adhesion or in any other suitable manner. These connection lines may also be formed as continuous lines or as discontinuous lines, comprising dots, short lines, rectangles or the like. Such an embodiment is illustrated in FIG. 8, where two separated connection lines 33*a* and 33*b* are provided between each pair of adjacent coil springs 31 within each string.

The connection lines may be achieved by joining together the cover material on each side of the strings by welding, either as a continuous weld or as spot welds. Alternatively, it is instead possible to provide one or several interconnection elements to join-together the cover material, such as one or several stitched seams, clamps, etc.

These separation distances preferably are arranged between essentially all springs in the lengthwise direction of the strings, which may be in the length or width direction of the mattress.

The cushioning pads may have a width extension in the width direction of the strings, wherein the width extension is smaller than the length extension. The width extension may e.g. be essentially equal to the diameter of the largest one of the spiral turns of the coil springs. However, alternatively, the width extension of each cushioning pad may also exceed the diameter of the largest one of the spiral turns of the corresponding coil spring.

The length extension of the cushioning pads preferably exceeds the diameter of the largest one of the spiral turns of the corresponding coil springs by at least 20%. Most preferably, the length extension of the cushioning pads exceeds the diameter of the largest one of the spiral turns of the corresponding coil springs by 75-100% of the interjacent separation distance between the coil springs, and more preferably by 80-100%, and most preferably by 90-100%.

The interjacent separation distance between the coil springs preferably exceeds 2 cm, and more preferably exceeds 4 cm, and most preferably exceeds 6 cm.

The cushioning pads preferably have a length extension in the longitudinal direction of the strings exceeding the diameter of the largest one of the spiral turns of the corresponding coil springs with at least 15%, and preferably at least 20%, and more preferably at least 25%, and most preferably at least 50%.

It is particularly preferred that mattresses in accordance with the invention have a spring density in at least one lengthwise direction, in which separation distances are provided, of less than 15 springs per meter, and preferably less than 13 springs per meter. The resulting mattress is a great deal more simple and less expensive than conventional mattresses, which as a rule have 30 springs and more in the lengthwise direction of the mattress.

The cushioning pads are preferably arranged on top of the coil springs in such a way that the cushioning pads extend out from the corresponding coil springs in the longitudinal direction of the strings. Preferably, the cushioning pads are arranged essentially centralized over each corresponding coil spring, so that the cushioning pads extends out from the coil spring with essentially the same length on each side, both in the length direction of the strings and in the width direction of the strings. Hereby, the support offered by the cushioning pads, in particular at the interjacent separation between the coil springs, is improved, providing a more comfortable mattress.

Each pocket unit comprises at least two compartments, one for housing the coil spring and one for accommodating the cushioning pad at one side of the mattress. However, it is also feasible to provide three or more compartments. For example, the individually pocketed coil spring units may comprise a compartment housing a cushioning pad both at the upper and lower ends of the coil springs. Hereby, cushioning pads will be provided at both sides of the mattress.

The coil spring preferably comprises an upper end turn, a lower end turn and a plurality of convolutions between said end turns. Preferably, the coil spring comprises 2-10 convolutions, and most preferably 5-8 convolutions.

Each casing/pocket contains at least one, and preferably only one, helical coil spring. The springs may have a spiral turn with a diameter of approximately 2 to 10 cm, and preferably about 6 cm. Preferably, the coil springs are barrel shaped, having upper and lower turns having a smaller diameter than the turns at the centre of the springs. However, alternatively the convolutions may all have identical diameter, or may have other variations in diameters. For example, the coil springs may be in the form of an hour-glass-shaped coil spring or any other shapes of springs.

The height of the cushioning pads is preferably of the same order as the height of the coil springs. The height of the cushioning pads is preferably in the range of 2-10 cm, and preferably in the range 3-7 cm, and most preferably in the range 5-6 cm. The height of the coil springs preferably corresponds to 50-100% of the height of the corresponding coil springs, and preferably corresponds to 50-90% of the height of the corresponding coil springs, and most preferably to 60-80%.

The cushioning pads may be formed by a single material, or by several different materials. For example, the cushioning pads may have a layered structure, e.g. comprising a foam center piece, an upper fabric piece and a lower fabric piece. The upper and lower fabric pieces may be glued or otherwise secured to the upper and lower surfaces of the foam center piece. Alternatively, the cushioning pad may comprise a single or multiple pieces of foam with or without any cloth pieces. The foam piece may be made of polyurethane, latex or any other conventional foam material. Alternatively, pads of cotton or any other material may be used. Pads of gel or the like may also be used, optionally enclosed in envelopes.

Although the cushioning pads are illustrated as being generally rectangular in shape, and with rounded or beveled corners, they may alternatively be any other shape or configurations, such as having an oval shape, square shape or any other desired shape. Similarly, the height of the cushioning pads may be varied as deemed appropriate and suitable for any particular application.

Different cushioning pads and/or coil springs may also be used in different individually pocketed coil spring units, in order to provide various properties in different parts of the mattress. This may e.g. be used to form zones having different properties in the mattress.

As illustrated in FIGS. 1, the mattress 1 has a generally planar top surface, formed by the individually resilient cushioning pads.

The compartments in the casing may be provided in various ways, and two exemplary embodiments are illustrated in FIGS. 2 and 3.

In the embodiment of FIG. 2, the first compartment and the second compartment are formed by a single piece of fabric. The casing material is here arrange in an S-shape to form the separate compartments, in a way similar to the disclosure in U.S. Pat. No. 6,397,418 and WO 2014/166927 by the same applicant, said documents hereby being incorporated in their entirety by reference. A first part of the casing material forms the first compartment 21, and the compartment is closed by the longitudinal connecting line 32, being arranged at the side of the unit. Part of the material extends past the longitudinal connecting line 32, and is brought back towards the other side of the unit, and connected to the side of the first compartment 21 by means of a second longitudinal connecting line 34. Hereby, the second compartment 22 is formed on top of the first compartment 21.

In an alternative embodiment, illustrated in FIG. 3, a first piece of casing material is used to form the first compartment, and a second piece of fabric forms the second compartment, in a way similar to the disclosure in WO 2014/166927 by the same applicant, said document hereby being incorporated in its entirety by reference. Thus, in this embodiment the first piece of casing material forms conventional pockets for pocketing coil springs, and the second piece of fabric forms the additional second compartment for housing of the cushioning pad.

The first piece of fabric hereby preferably entirely encloses the coil spring, and the second piece of fabric is arranged to be placed over the top of the first compartment, partly enclosing the first compartment, and to be secured to the first piece of fabric.

The second piece of fabric may be connected to the first compartment by means of longitudinal connection lines 35, and/or by means of transverse connection lines 33*a-c*.

In this embodiment, the first fabric may be provided with the first transversal connection lines 33*a* and 33*b* forming the interjacent separation distance between the coil springs, as best seen in FIG. 4. Further, the second fabric may be provided with more narrow second transversal connection lines 33*c*, such as a narrow single second transversal connection line, between each pair of adjacent cushioning pads, so that the cushioning pads are arranged close to each other, without any significant separation distance between them.

In this embodiment, the second fabric may be connected to the first fabric via the first transversal connection lines 33*a*, 33*b* in the area where the first and the second fabric overlap by extending the connection lines in this area through both the first and the second fabric. Additionally or alternatively, the second fabric may be connected to the first fabric via the second transversal connection lines 33*c* in the area where the first and the second fabric overlap by extending the connection line through both the first and the second fabric. Additionally or alternatively, a separate connection may be provided between the first and the second fabric. Such a separate connection may be arranged overlying or adjacent to the first and/or the second transversal connection lines. It is also feasible, as an alternative or in addition, to connect the second piece of fabric to the first piece of fabric by longitudinal connection lines 35.

Preferably, the second fabric is attached to the first fabric solely by connection points or connection lines formed by or arranged overlying or adjacent the first and/or second transversal connection lines 33*a-c*. Hereby, connection of the second piece of fabric may easily be incorporated in the conventional pocket spring manufacturing process.

The above-discussed connection lines, arranged longitudinally or transversely, preferably consist of a surface joint, such an adhesive, a weld or the like. The connection lines may be arranged as continuous straight or non-straight lines, or as discontinuous lines, comprising dots or the like arranged along a line.

In the same way as in the above-discussed embodiment comprising two pieces of material, as illustrated in FIG. 3, the embodiment using only a single piece of material to form the compartments, as shown in FIG. 2, may also be provided first transversal connection lines 33*a*, 33*b* forming the interjacent separation distance between the coil springs, such as by use of two parallel, separated first transversal connection lines between each pair of adjacent springs, and more narrow second transversal connection lines 33*c*, such as a narrow single second transversal connection line, between each pair of adjacent cushioning pads, so that the cushioning pads are arranged close to each other, without any separation distance between them, or with only a very small separation distance. Further, the loose ends of the single piece of fabric may be connected together at the overlapping areas by the first and/or second transversal connection lines 33*a-c*, or, additionally or alternatively, by a separate connection, such as by the longitudinal connection lines 32, 34.

At the side of the mattress being opposite to the cushioning pads, a stabilizing sheet 7 may be connected to the strings. This stabilizing sheet is preferably made of a flexible material, and may e.g. comprise a fabric, such as a non-woven fabric, and preferably extends over the entire mattress surface. The sheet may be connected to the bottom side of the strings by adhesive, welding or the like. The stabilizing sheet hereby stabilizes the mattress in the side being opposite to the cushioning pads, and assists in maintaining the coil springs in upright, separated positions.

However, alternatively, the pocket spring mattress may, as already discussed, further comprise second cushioning pads located below the lower end of each coil spring.

Figure 6:
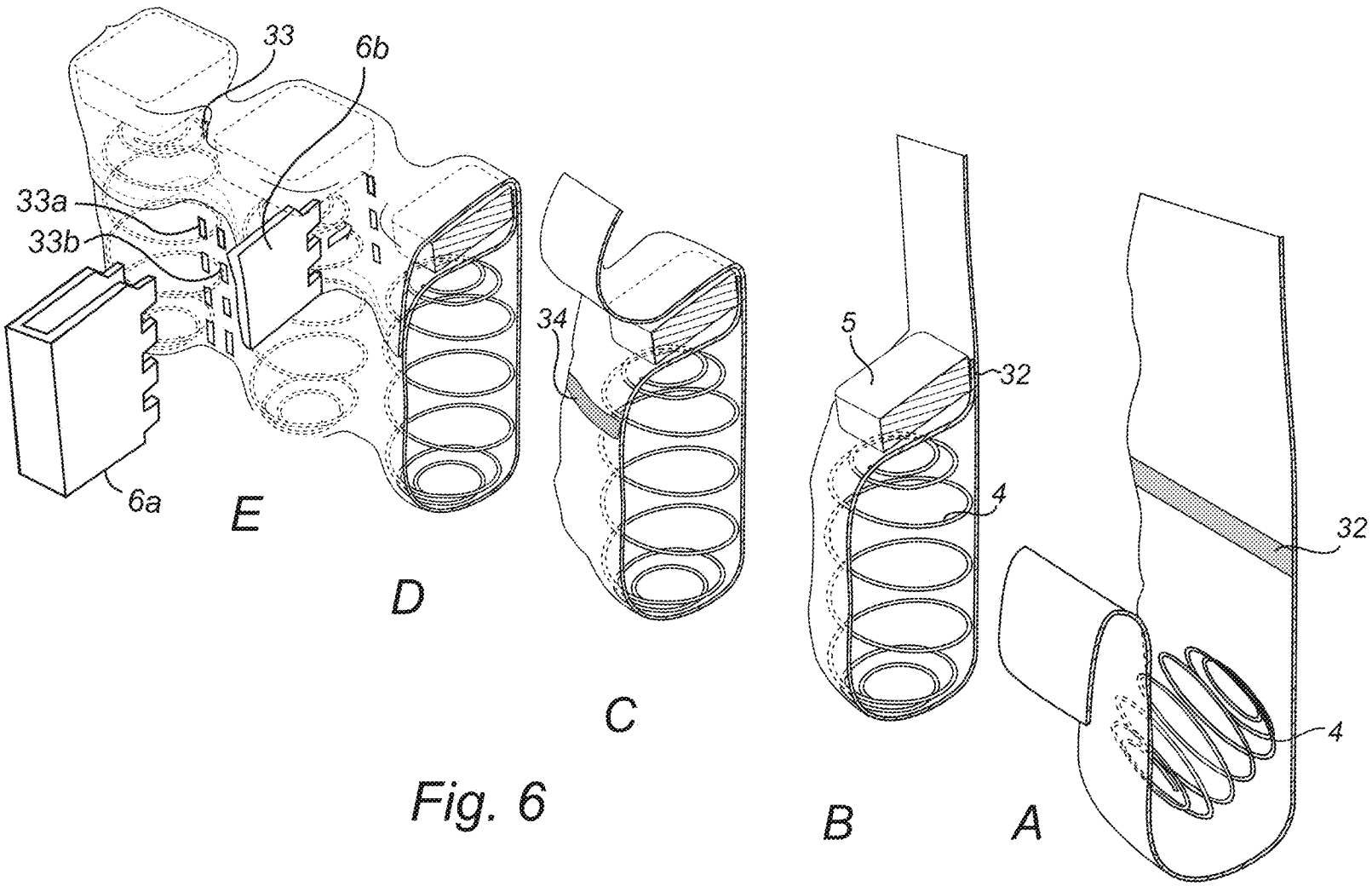
FIG. 6 is a schematic and partly cross-sectional perspective view, illustrating various method steps for the production of the individually pocketed coil springs of FIG. 2.

In FIG. 6, there is shown a schematic production method and production device for producing a continuous string of individually pocketed coil springs of the type discussed above with reference to FIG. 2.

First, a continuous fabric is folded or wrapped to form two plies of fabric connected to each other at one side. Alternatively, two separate plies of fabric may be connected to each other at one side. Compressed coil springs are inserted between the plies, as is shown at position A. Thereafter, the plies are connected to each other at the open end, along a longitudinal connection line 32, thereby encircling the inserted coil spring. In this position, the coil springs may be turned, if inserted in a rotated position, and allowed to expand. One of the plies extends past the connection line 32. Thereafter, a cushioning pad 5 is arranged on top of the enclosed coil spring. This stage is shown at position B. The extended ply is thereafter wrapped over the cushioning pad, as is shown at position C.

The wrapped ply may be connected at the other side along a longitudinal connection line 34. However, it is also feasible to connect the wrapped over ply only by transverse connection lines. This state is illustrated in FIG. D.

Thereafter, the transverse connection lines 33 are formed, dividing the string into separate pockets, so that each individual unit comprises two compartments, and so that each compartment comprises only one coil spring or only one cushioning pad. This state is illustrated in FIG. E. The transverse connection lines 33 here serves multiple purposes. The one or several transverse connection lines 33*a* and 33*b* arranged at the lower end, between the coil springs, separate the coil springs from each other, forming individual pocket compartments for the springs, and also form the interjacent separation distance between the springs. The transverse connection line 33*c* at the upper end separates the cushioning pads from each other, forming individual pocket compartments for the cushioning pads, and allowing the cushioning pads to be arranged close to each other along the length of the string. Further, one or both of the upper or lower transverse connection lines also preferably connect the material forming the second compartments to the first compartments at the overlapping areas.

The transverse connection lines 33*a-c* may e.g. be formed by welding. E.g. it is possible to use a heating element 6*a* for forming the lower transverse connection lines 33*a-b*, and a separate heating element 6*b* for forming the upper transverse connection line 33*c*. However, alternatively a single heating element may be used, to form all the transverse connection lines 33*a-c*, either after each other or simultaneously. The heating elements are preferably ultrasonic heating element, which are moveable towards the string, thereby applying heat to form weld at desired positions. However, other ways of forming welds are also feasible, as is well known to the skilled addressee.

Figure 7A:
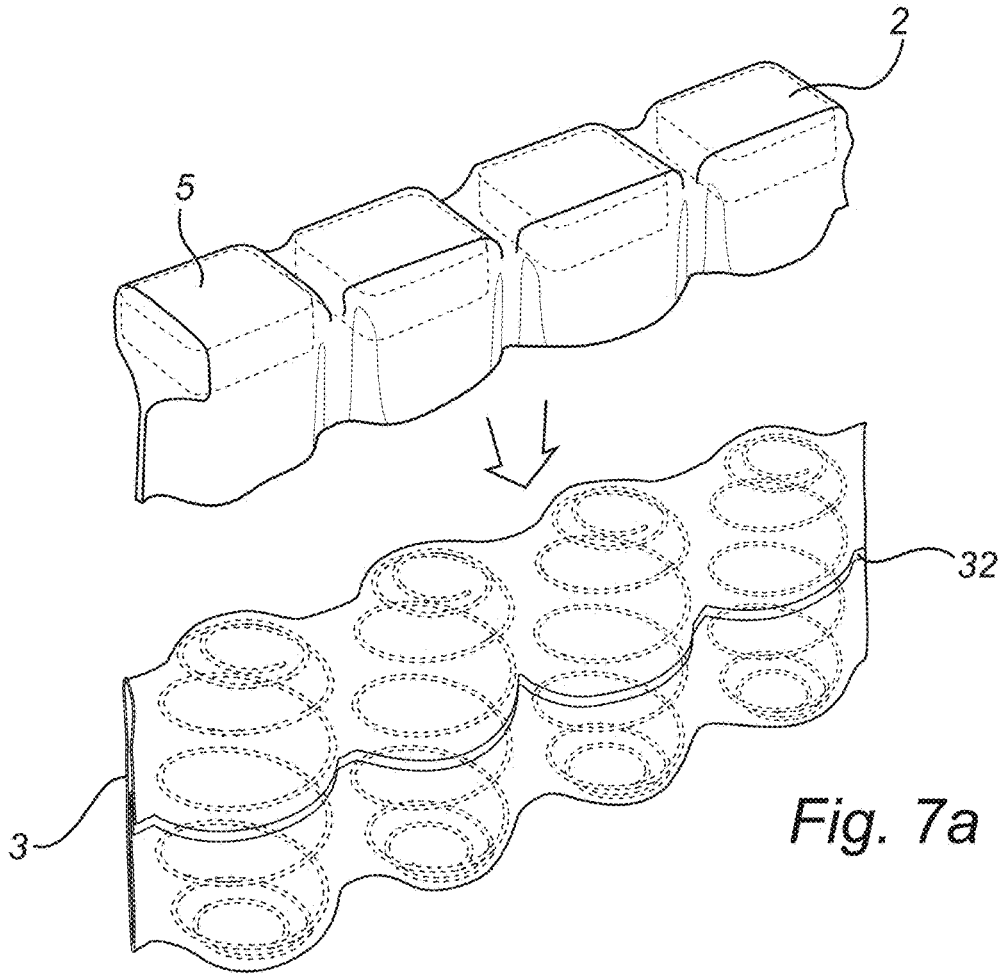
FIGS. 7*a* and 7*b* are schematic perspective views, illustrating various method steps for the production of the individually pocketed coil springs of FIG. 3.
Figure 7B:
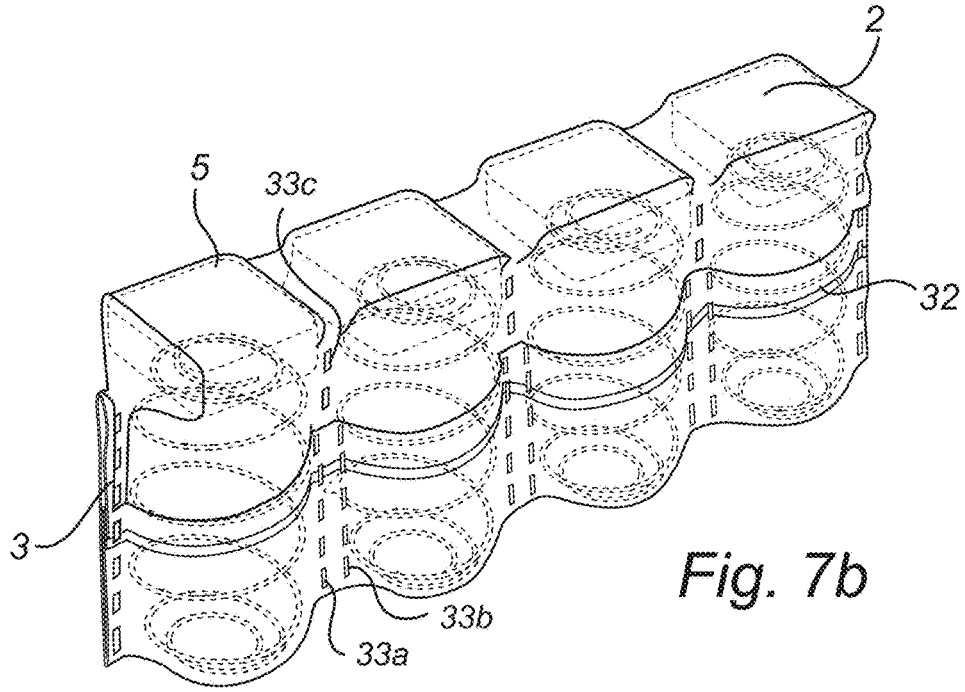

In FIG. 7, there is shown a schematic production method and production device for producing a continuous string of individually pocketed coil springs of the type discussed above with reference to FIG. 3.

First, a continuous fabric is folded or wrapped to form two plies of fabric connected to each other at one side. Alternatively, two separate plies of fabric may be connected to each other at one side. Compressed coil springs are inserted between the plies. Thereafter, the plies are connected to each other at the open end, along a longitudinal connection line 32, thereby encircling the inserted coil spring. In this position, the coil springs may be turned, if inserted in a rotated position, and allowed to expand. This state is shown schematically in FIG. 5*a*.

Thereafter, a second piece of fabric is provided above the coil springs, and cushioning pads are provided between the enclosed coil springs and the second piece of fabric. This is also shown schematically in FIG. 5*a*.

The second piece of fabric is wrapped over the cushioning pads and over the top of the enclosed coil springs. Thereafter, the transverse connection lines 33*a-c* are formed, dividing the string into separate pockets, so that each individual pocket unit comprises two compartments, and so that each compartment comprises only one coil spring or only one cushioning pad. The transverse connection lines 33*a-c* here serve the purposes of separating the compartments housing the coil springs from each other, separating the compartments housing the cushioning pads from each other, forming the interjacent separation distance between the coil springs, and connecting the second material forming the second compartments to the first compartments. This is illustrated schematically in FIG. 5*b*.

As in the previous example, the transverse connection lines 33 may e.g. be formed by welding. E.g. it is possible to use one or several heating element(s), such as an ultrasonic weld equipment, which is moveable towards the string, thereby applying heat to form weld at desired positions. However, other ways of forming welds are also feasible, as is well known to the skilled addressee.

The lower transverse connection lines 33*a-b* preferably extends generally from a lower surface of the string of springs towards an upper lower surface of the string of springs, and preferably extends at least a length approximately corresponding to the height of the springs. However, the length extension may also be more limited. The upper transverse connection lines 33*c* preferably extends generally from the upper surface of the string of springs towards the lower surface of the string of springs, and preferably extends at least a length approximately corresponding to the height of the cushioning pads. However, the length extension may also be more limited, and may, alternatively also be longer, e.g. extending into the area between the coil springs, and possibly even extending over the entire height of the string.

Figure 10:
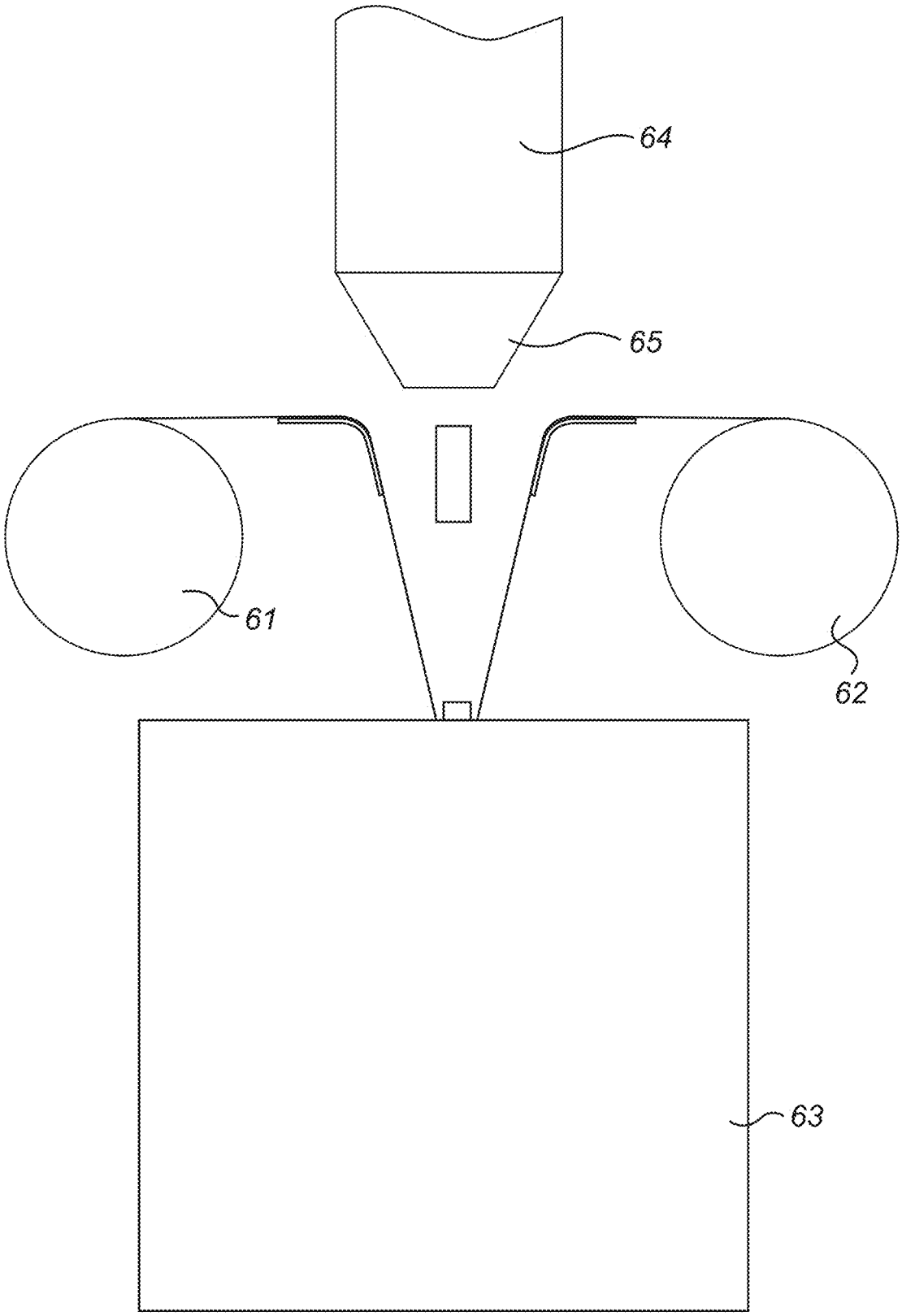
FIG. 10 is a schematic view illustrating a manufacturing apparatus for use in conjunction with the method illustrated in FIG. 7.

The first and second piece of fabric may be provided continuously and simultaneously, as is shown schematically in FIG. 10. Thus, the first fabric may be provided from a first roll 61 of material, and the second fabric may be provided from a second roll 62 of material. The fabrics are then guided into a manufacturing apparatus 63 where the materials are formed into pockets each having two compartments, in the way discussed above. The cushioning pads are preferably provided between the sheets of fabric. For example, pre-cut cushioning pads may be provided in a cushioning pad supply 64, such as a magazine or other form of supply, and be dispensed between the two sheets of fabric by a dispenser 65 or the like. Alternatively, the cushioning pads may be provided as a continuous string, which is cut into suitable lengths immediately prior to being dispensed.

By this arrangement, correct positioning of the cushioning pads is enabled in a very convenient and efficient manner. The cushioning pads will be moved along with the sheets of fabric during the entire manufacturing process, and will be held and maintained in a correct position by the friction of the sheets.

Thus, in both the above-discussed methods, it is possible to use a conventional manufacturing process for making pocket mattresses, and to simply add a separate compartment on top of each pocket unit to incorporate the cushioning pad. Hereby, the present invention lends itself very well to automated and cost-efficient manufacturing, and it is also relatively simple to incorporate the additional steps of providing a separate compartment for the cushioning pad and to insert such cushioning pads into said compartments in previously known and used manufacturing processes.

Notably, the order of the above defined method steps may vary. For example, the enclosing of the springs and the enclosing of the cushioning pads may, in an automated manufacturing procedure be made in any order, and can also be made simultaneously. Further, the connection lines can be provided in any order, and can also be provided simultaneously.

To form a pocket spring mattress for use in a bedding or seating product, comprising a plurality of parallel strings of individually pocketed coil springs, strings formed as discussed above may be connected together, side-by-side, e.g. by providing surface attachments between adjacent surfaces. For example, it is possible to use glue, Velcro, ultrasonic welding, clamps or the like to connect such strings.

Figure 5:
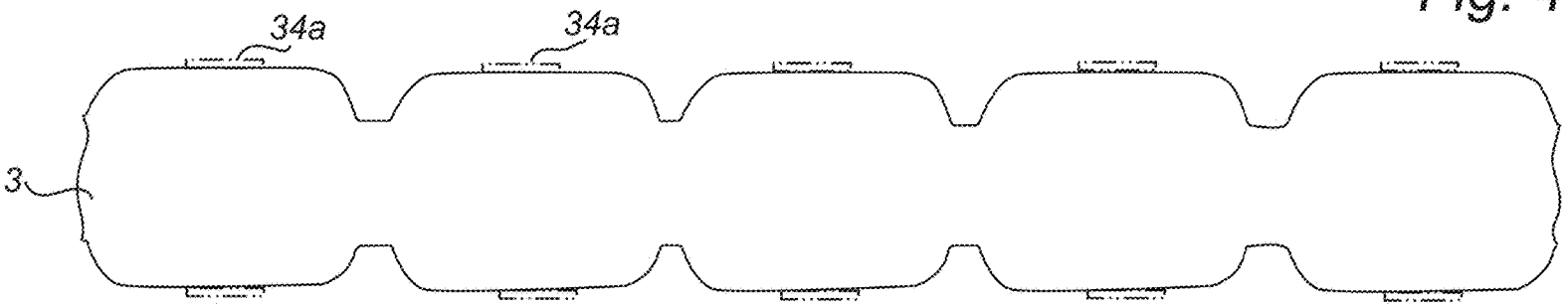
FIG. 5 is a top view of the string in FIG. 4.

The surface attachments are preferably arranged at the center of each coil spring, where the springs in neighboring strings are closest to each other. The surface attachments may be formed as continuous lines, extending over the entire string height, or over a part of the string height. Alternatively, the surface attachments may be formed at discrete positions, such as connection spots or the like. Such an embodiment is illustrated in FIGS. 4 and 5. Here, connection spots 34*a* are formed at an upper part of the string, connection spots 34*b* are formed at a central part of the string, and connection spots 34*c* are formed at a lower part of the string. However, more or fewer connection spots may be used. For example, it is feasible to use only the connection spots 34*b* and 34*c*, only the connection spots 34*b*, only the connection spots 34*c*, etc.

Preferably, there is no connection between neighboring strings at the upper parts of the strings, leaving the parts housing the cushioning pads, and possibly also the parts housing the upper part of the coil springs unconnected. This improves the individual resilience of the pocket units, and increases the comfort of the mattress.

The surface attachment connecting the strings together may be provided between every pair of adjacent coil springs, as in the illustrative example of FIGS. 4 and 5. However, fewer connections may also be used, such as providing surface attachments only at every second or every third pocket unit along the length of the string.

Figure 11:
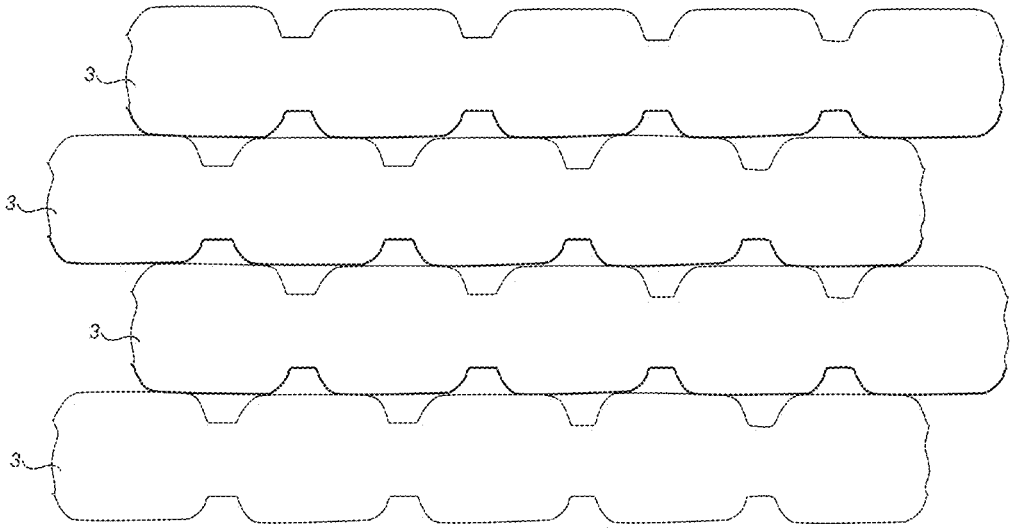
FIG. 11 is a top view of a part of a mattress in accordance with another embodiment of the present invention, wherein the strings are arranged in a staggered configuration.

In the embodiments discussed so far, the strings are arranged so that the pockets of the different strings are aligned with each other, and consequently abuts each other at the outermost sides, being farthest away from the longitudinal centerlines of each string. However, it is alternatively possible to arrange the strings in a staggered configuration, as is shown schematically in FIG. 11. Preferably, the strings are staggered by a distance corresponding to half the length of a pocket. Hereby, the contact area between the strings becomes larger, allowing a firmer connection between the strings. This arrangement also enables a firmer and more dense mattress. In such an arrangement, the width of the cushioning pads may be somewhat smaller than in the previously discussed embodiments, whereas the length of the cushioning pads remains as before.

Since the cushioning pads maintain stability of the mattress, there is generally no need for any additional structure to enhance stability. However, the assembly of parallel strings of springs may optionally be joined to upper and/or lower generally rectangular border wires located in the top and bottom planes of the bedding or seating product, such as a steel frame. In particular, such a frame may be used at the side of the mattress where there are no cushioning pads.

Further, due to the smooth surface provided by the cushioning pads, there is generally no need for any additional covering or upholstering. However, optionally a covering pad may be placed over the spring assembly and/or an upholstered covering placed above the pocket spring mattress.

The mattress may be enclosed in a cover, e.g. made of a textile material.

Each string of springs preferably comprises a row of individual coil springs, a strip of fabric surrounding the coil springs and a plurality of cushioning pads placed on top of the coil springs outside the fabric enclosing the coil springs. The strip of fabric in each string is divided into a plurality of pockets by spaced transverse lines of attachment. Each pocket contains one the coil springs, and an additional compartment above each coil spring encloses at least one cushioning pad located above the coil spring The casing material is preferably made of a weldable textile material.

Figure 12:
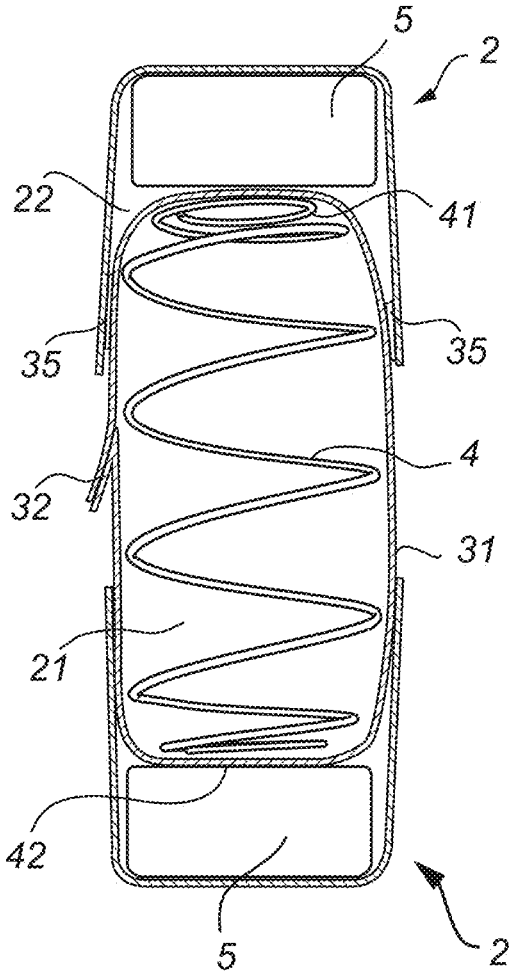
FIG. 12 is a cross-sectional view of an individually pocketed coil spring in accordance with a further embodiment of the present invention.

In another embodiment, as illustrated in FIG. 12, an additional cushioning pad or pads may be located below the coil spring in an additional compartment, e.g. formed and connected in the same way as the upper compartment.

The mattress may further comprise foam material, e.g. made of polyether, arranged at one or several of the long sides and short sides of the mattress. The foam material is preferably cut into rectangular blocks and attached to the sides of the strings. In particular, it is preferred to add foam blocks to one or both long sides of the mattress. The foam blocks may e.g. be of a similar size as the strings, enabling the foam blocks to be attached to the sides of the outermost strings during assembly of the mattress in the same process as in which the strings are attached to each other. Hereby, no additional manufacturing steps or processes are needed, and there is no longer any need for arranging the mattress in a conventional polyether boxe and the like.

The mattress may be used for many different purposes, such as in a bed, a davenport, and other type of furniture intended for sleeping, resting and sitting. The mattress is particularly well suited for use in vehicles, such as for bunk beds in trucks.

The person skilled in the art realizes that the present invention by no means is limited to the preferred embodiments described above. On the contrary, many modifications and variations are possible within the scope of the appended claims. For instance, more than one cushioning pad may be arranged in each individually pocketed coil spring unit. Further, the separation distance between the coil springs may be varied between mattresses, and may also be varied within a single mattress, e.g. for provision of zones with different properties within the mattress. It is e.g. possible to use larger separation distances in areas that in normal use of the mattress are less exposed to load, and smaller separation distances in areas exposed to more heavy loads. Further, the separate compartments of the units may be formed in various ways, e.g. by a single piece of fabric, or by two or more separate pieces of fabric. Such and other modifications of the pocket units and the mattress formed by such units form part of the present invention, as it is defined in appended claims.

The invention claimed is:

1. A pocket spring mattress for use in a bedding or seating product comprising a plurality of interconnected coil springs enclosed in continuous covers forming strings of pockets accommodating the coil springs, the coil springs within each string being separated by transversal connection lines, and a plurality of such strings being arranged in parallel with each other and connected to each other, wherein adjacent coil springs within each string are spaced apart by an interjacent separation distance, said separation distance exceeding at least 20 percent of the diameter of the largest one of the spiral turns of the adjacent coil springs, the coil springs each having an upper and a lower end, and the pocket spring mattress further comprising a cushioning pad located above the upper end of each coil spring, wherein the covers provides first compartments enclosing the coil springs, and second compartments enclosing the cushioning pads, said first and second compartments being separated from each other, and wherein the cushioning pads each has a length extension in the longitudinal direction of the strings exceeding the diameter of the largest one of the spiral turns of the corresponding coil spring and a width extension in the width direction of the strings, wherein the width extension is smaller than the length extension, wherein two transversal connection lines are provided between adjacent coil springs, said lines being spaced apart in the longitudinal direction of the strings, and wherein single second transversal connection lines are provided between each pair of adjacent cushioning pads.

2. The pocket spring mattress according to claim 1, wherein said separation distance exceeds 25 percent of the diameter of the largest one of the spiral turns of the adjacent springs.

3. The pocket spring mattress according to claim 1, wherein the transversal connection lines have a width in the lengthwise direction of the strips forming said separation distance.

4. The pocket spring mattress according to claim 1, wherein two transversal connection lines are provided between adjacent coil springs, said lines being spaced apart in the longitudinal direction of the strings to form said separation distance.

5. The pocket spring mattress according to claim 1, wherein the cover comprises a first piece of fabric forming said first compartment, and a second piece of fabric forming said second compartment.

6. The pocket spring mattress according to claim 5, wherein the first piece of fabric entirely encloses the coil spring, and the second piece of fabric is arranged to partly enclose the first compartment, and to be secured to the first piece of fabric.

7. The pocket spring mattress according to claim 6, wherein the second piece of fabric is secured to the first piece of fabric along at least one transverse connection line extending parallel to the longitudinal direction of the coil spring, said connecting line(s) preferably comprising a surface joint, such an adhesive joint, a seam or a welded joint.

8. The pocket spring mattress according to claim 1, wherein the cushioning pads have a length extension in the longitudinal direction exceeding the diameter of the largest one of the spiral turns of the coil springs with at least 15%.

9. The pocket spring mattress according to claim 1, wherein each cushioning pad includes at least one piece of foam, and preferably foam made of urethane or latex.

10. The pocket spring mattress according to claim 1, wherein the width extension of each cushioning pad is essentially equal to the diameter of the largest one of the spiral turns of the coil springs.

11. The pocket spring mattress according to claim 10, wherein the cushioning pads have a generally rectangular configuration, and with beveled or rounded corners.

12. The pocket spring mattress according to claim 1, wherein the cushioning pads comprise a layered construction, comprising two or more different materials arranged in a sandwiched configuration, such as a piece of softer foam secured to a piece of firmer foam.

13. The pocket spring mattress according to claim 1, further comprising a stabilizing sheet connected to the strings at an end opposite to said cushioning pads.

14. The pocket spring mattress according to claim 1, wherein the parallel strings are arranged side by side and interconnected by surface attachment between abutting surfaces, wherein the surface attachment adapted to interconnect the strings preferably comprises at least one of gluing and welding.

15. The pocket spring mattress according to claim 1, wherein said separation distance exceeds 30 percent of the diameter of the largest one of the spiral turns of the adjacent springs.

16. The pocket spring mattress according to claim 1, wherein said separation distance exceeds 50 percent of the diameter of the largest one of the spiral turns of the adjacent springs.

17. The pocket spring mattress according to claim 1, wherein the cushioning pads have a length extension in the longitudinal direction exceeding the diameter of the largest one of the spiral turns of the coil springs with at least 25%.

18. The pocket spring mattress according to claim 1, wherein the cushioning pads have a length extension in the longitudinal direction exceeding the diameter of the largest one of the spiral turns of the coil springs with at least 50%.

19. A method of manufacturing a spring mattress of the kind comprising a plurality of interconnected coil springs enclosed in continuous covers forming strings of pockets accommodating the coil springs, comprising:

enclosing the springs in a continuous cover material;

forming pockets in the continuous cover material by providing transversal connection lines between adjacent coil springs; and interconnecting several strings with one another;

wherein adjacent coil springs within each string are spaced apart by an interjacent separation distance, said separation distance exceeding at least 25 percent of the diameter of the largest one of the spiral turns of the adjacent coil springs, the coil springs each having an upper and a lower end, and the further comprising providing a cushioning pad above the upper end of each coil spring, wherein the covers provides first compartments enclosing the coil springs, and second compartments enclosing the cushioning pads, said first and second compartments being separated from each other, and wherein the cushioning pads have a length extension in the longitudinal direction of the strings exceeding the diameter of the largest one of the spiral turns of the coil springs and a width extension in the width direction of the strings, wherein the width extension is smaller than the length extension, and wherein two transversal connection lines are provided between adjacent coil springs, said lines being spaced apart in the longitudinal direction of the strings, and wherein single second transversal connection lines are provided between each pair of adjacent cushioning pads.

20. A pocket spring mattress for use in a bedding or seating product comprising a plurality of interconnected coil springs enclosed in continuous covers forming strings of pockets accommodating the coil springs, the coil springs within each string being separated by transversal connection lines, and a plurality of such strings being arranged in parallel with each other and connected to each other, wherein adjacent coil springs within each string are spaced apart by an interjacent separation distance, said separation distance exceeding at least 20 percent of the diameter of the largest one of the spiral turns of the adjacent coil springs, the coil springs each having an upper and a lower end, and the pocket spring mattress further comprising a cushioning pad located above the upper end of each coil spring, wherein the covers provides first compartments enclosing the coil springs, and second compartments enclosing the cushioning pads, said first and second compartments being separated from each other, and wherein the cushioning pads each has a length extension in the longitudinal direction of the strings exceeding the diameter of the largest one of the spiral turns of the corresponding coil spring and a width extension in the width direction of the strings, wherein the width extension is smaller than the length extension, wherein the transversal connection lines have a width in the lengthwise direction of the strips forming said separation distance, and wherein two transversal connection lines are provided between adjacent coil springs, said lines being spaced apart in the longitudinal direction of the strings to form said separation distance, and wherein narrower second transversal connection lines are provided between each pair of adjacent cushioning pads.

* * * * *